United States Patent [19]

Gamblin

[11] Patent Number: 4,528,070

[45] Date of Patent: Jul. 9, 1985

[54] ORIFICE PLATE CONSTRUCTIONS

[75] Inventor: Rodger L. Gamblin, Dayton, Ohio

[73] Assignee: Burlington Industries, Inc., Greensboro, N.C.

[21] Appl. No.: 464,101

[22] Filed: Feb. 4, 1983

[51] Int. Cl.[3] ..... C25D 1/08

[52] U.S. Cl. ..... 204/11; 204/24

[58] Field of Search ..... 204/11, 24, 15

[56] References Cited

U.S. PATENT DOCUMENTS

| | | | |
|---|---|---|---|
| 2,069,566 | 2/1937 | Tuttle et al. . | |
| 2,633,631 | 4/1953 | Horvitz | 428/679 |
| 2,684,892 | 7/1954 | Saulnier | 156/666 |
| 3,041,254 | 6/1962 | Pedler . | |
| 3,041,255 | 6/1962 | Passal et al. . | |
| 3,104,167 | 9/1963 | Cotteta | 75/97 R |
| 3,192,136 | 6/1965 | Reid | 204/11 |
| 3,303,111 | 2/1976 | Peach . | |
| 3,449,221 | 6/1969 | Thomas | 204/11 |
| 3,475,293 | 10/1969 | Haynes et al. . | |
| 3,658,569 | 4/1972 | Phillipp et al. . | |
| 3,759,803 | 9/1973 | DuRose et al. . | |
| 4,033,831 | 7/1977 | Bakewell | 204/24 |
| 4,086,149 | 4/1978 | Martinsons et al. . | |
| 4,106,975 | 8/1978 | Berkenblit et al. | 156/628 |
| 4,106,976 | 8/1978 | Chiou et al. | 156/644 |
| 4,108,739 | 8/1978 | Tadokoro et al. . | |
| 4,113,248 | 9/1978 | Yanagioka . | |
| 4,127,709 | 11/1978 | Ruben . | |
| 4,169,008 | 9/1979 | Kurth | 156/600 |
| 4,184,925 | 1/1980 | Kenworthy | 204/11 |
| 4,224,133 | 9/1980 | Takahashi . | |
| 4,229,265 | 10/1980 | Kenworthy | 204/11 |
| 4,374,707 | 2/1983 | Pollack | 204/11 |

FOREIGN PATENT DOCUMENTS

| | | | |
|---|---|---|---|
| 1240260 | 7/1971 | United Kingdom | 204/11 |

OTHER PUBLICATIONS

"Chemical Engineers' Handbook", Fifth Edition, 1973 (Robert H. Perry et al.) pp. 23.26–23.27.

Maissel et al., Handbook of Thin Film Technology, McGraw-Hill, Inc., Chapter 7 (1970).

A. Kenneth Graham, Electroplating Engineering Handbook, 3rd Ed., Van Nostrand Reinhold Co., New York, N.Y., pp. 486–507 (1981).

A. Brenner, "Electrodeposition of Alloys", Vol. II, Academic Press, New York, N.Y., Chapter 35 (1963).

*Primary Examiner*—Thomas Tufariello

*Attorney, Agent, or Firm*—Cushman, Darby & Cushman

[57] ABSTRACT

Improved orifice plates such as, fluid jet orifice plates, photoetching masks or the like, include a substrate of highly corrosion resistant metal and a layer of an amorphous metal alloy, such as, an amorphous nickel-phosphorus alloy or an amorphous cobalt phosphorus alloy, the alloy layer and substrate together defining a predetermined array of openings therein.

41 Claims, 9 Drawing Figures

ORIFICE PLATE CONSTRUCTIONS

INTRODUCTION

The present invention is generally directed to novel and improved orifice plate constructions. More particularly, the present invention relates to novel and improved orifice plate constructions utilized in fluid jet printing apparatuses or used as a mask in photo-etching processes.

As used herein and in the accompanying claims, therefore, the term "orifice plate" shall refer to any substrate member having orifices, apertures, openings or pattern areas of various dimensional and geometric configurations defined therein. Thus, although the discussion which follows will be directed to specific applications of the present invention, e.g. fluid jet orifice plate construction and photo-etching mask construction, the reader should appreciate that such applications merely represent preferred embodiments of the present invention and are thus nonlimiting with respect thereto.

BACKGROUND AND SUMMARY OF THE PRESENT INVENTION

There presently exists a wide variety of printing apparatuses utilizing fluid jet technology. Typically, such prior art apparatuses provide a linear array of fluid jet orifices formed in an orifice plate from which filaments of pressurized marking fluid (e.g., ink, dye, etc.) are caused to issue. An individually controllable electrostatic charging electrode is disposed downstream in registry with each orifice along the so-called "drop formation" zone. In accordance with known principles of electrostatic induction, the fluid filament is caused to assume an electrical potential opposite in polarity and related in magnitude to the electrical potential of its respective charging electrode. When a droplet of fluid is separated from the filament, this induced electrostatic charge is then trapped on and in the droplet.

According to conventional procedures, fluid jet orifice plates have been constructed utilizing standard techniques borrowed from the semiconductor industry for the manufacture of semiconductors, etc. (see, e.g. Maissel et al, Handbook of Thin Film Technology, McGraw-Hill, Inc., Chapter 7 (1970), the disclosure thereof being expressly incorporated hereinto by reference).

A conventional prior art procedure for making fluid jet orifice plate 10 is depicted in FIGS. 1*a*–1*e*. A substrate 12 of copper or copper alloy is coated on its front and back sides, 11, 13, respectively, with a suitable photoresist material 14 and covered with an exposure mask 16. Thereafter, the structure is exposed to light so as to develop areas bordering the circular masked areas 18 which will eventually define the orifice locations. The light exposed photoresist material is then removed from the substrate utilizing appropriate chemical wash compounds thereby leaving unexposed pegs 20 which were in registry with areas 18 of mask 16. The back side 13 of substrate 12 is treated in a similar manner so as to leave pegs 20 of a larger diameter and in registry with the smaller diameter pegs 20 on the front side 11.

Both sides of the substrate are thereafter electroplated with crystalline nickel 22, the nickel being deposited on the substrate on the areas from which the exposed photoresist was washed and thus not deposited on the pegs. The pegs on each side of the substrate are then dissolved and the copper substrate thereunder is preferentially etched form each side so as to form a hole 24 through the substrate connecting the front and back sides with the nickel coating defining the orifice 26.

The ink for typical ink jet apparatuses has been developed for paper printing and thus such ink formulations are chosen (insofar as possible) so as to be noncorrosive and benign to both the electroform crystalline nickel and the typical substrate of copper or copper alloy. Recently, however, fluid jet technology has expanded and applications have been identified in the textile industry (see, e.g., my copending U.S. patent application Ser. Nos. 231,326 filed Feb. 4, 1981 and 393,698 filed June 30, 1982). Such textile applications demand that fluids be compatible with the requirements of the fabric substrate onto which the fluid is applied. Oftentimes, however, the fluids typically required for textile applications are (to a somewhat greater extent than for paper printing) corrosive to both the copper or copper alloy orifice plate substrate and/or the crystalline nickel plated thereon. There are a great number of corrosive fluids typically encountered in textile applications and well known to those skilled in the textile arts which must be substantially benign to any fluid jet orifice plate in contact therewith.

Thus, conventional orifice plates are oftentimes inadequate and as a result a distinct need exists for orifice plates which are chemically stable (e.g., noncorrosive) in the presence of a wide range of chemical substances normally encountered in the textile industry. It is believed that until the present invention such need went unanswered.

The present invention specifically addresses the corrosive nature of certain fluids utilized in fluid jet apparatuses in textile applications by providing an orifice plate of improved construction. In accordance with the present invention, such advantageous qualities are realized by depositing amorphous nickel- or cobalt-phosphorus alloys onto a highly corrosion resistant substrate.

The reader should also appreciate that many critical parts for devices having one relatively thin dimension are typically made by a process of photofabrication. One such part is a fluid jet orifice plate for a fluid jet printing apparatus as briefly described above. In the photofabrication process, the substrate to be photofabricated is coated with a thin light-sensitive material called "photoresist" and exposed by means of light, usually blue or ultraviolet light to form an exposure pattern thereon. The light either degrades the photoresist to make it selectively soluble in a suitable solvent or cross links the molecules in the photoresist so as to make it selectively insoluble. In any case after exposure and development (so as to selectively remove soluble photoresist) a thin film of foreign material in a preselected pattern exists on the substrate to be photofabricated. At this point, a selective coating may be plated on the exposed substrate portions and the photoresist removed, or the substrate may go directly to the next step without such an intermediate plating step.

In the next step, the objective is to subject the substrate to an etchant that selectively attacks the substrate material. The photoresist in one case or the overplating in the other must not be attacked by the etchant. When a suitable etchant is found, the substrate to be etched experiences metal dissolution in the areas where the metal is exposed, the metal thus remaining where it is covered by protective material in the form of photoresist or overplating (e.g. see discussion above with regard to FIGS. 1*a*–1*e*).

It can be appreciated that most photoresist materials are thin plastic coatings such that as etching occurs and as they are undercut, the coatings pull away from the substrate and tend to detach in an intermittent fashion so as to give a ragged or irregular edge.

Electroplated masks that protect the substrate during etching as above are usually of metal and it can be appreciated that although they are rigid and resist detachment, must be resistant to the etchant so as to perform their intended masking function. In the case of materials such as stainless steels, titanium, zirconium, hafnium, tungsten, molybdenum, Monel metals, or some of the Hastelloys, it is very difficult to find a material for a mask that is selectively etched by known etchants. Thus, according to another aspect of this invention, a new and unexpected result of photoetchant protection by an alloy yields selective etching of a number of materials that have been found difficult to photoetch in the past and thus renders the present invention particularly suitable to photoetching masks having the desired exposure pattern formed therein.

The substrates advantageously utilized in accordance with the present invention can be any material which is highly corrosion resistant and thus is stable in contact with aqueous solutions for sustained periods of time. Suitable substrate materials can include, for example, Monel metals (e.g., copper-nickel alloys), ferritic stainless steels (e.g., stainless steel having low nickel content), titanium, zirconium, and martinsitic stainless steels. Of these suitable substrate materials, the stainless steels are preferred due to the relative ease with which etching can be accomplished (e.g., removal of the substrate after plating to form the openings in communication with the orifice). Similarly, the Monel metals can be preferentially etched by ferric chloride with the added advantage that less etch times are required.

As used herein the terms "preferential" etching, "selective" etching or like terms are meant to refer to etching of the substrate material without affecting the plated amorphous alloy layer.

Zirconium and titanium can be preferentially etched by utilizing hydrofluoric acid further acidified with hydrochloric acid. Bonding adhesion of the amorphous nickel- or cobalt-phosphorus alloy to titanium can be assured by preliminarily etching the surface thereof with hydrochloric acid in solution with an ethylene glycol combination and, thereafter, striking the surface with a copper cyanide strike. The "glassy" amorphous nickel- or cobalt-phosphorus alloy will securely adhere to the copper strike. Furthermore, zirconium may be initially prepared by plating the surfaces thereof in a Watts nickel bath, the surfaces being preliminarily treated in a soaking bath of hydrofluoric acid and acid salt. Amorphous nickel will therefore more readily adhere to the Watts nickel plating. Various other surface preparation procedures and techniques may be advantageously utilized and are believed to be well within the ordinary skill of those in the art.

The reader may wish to refer to the following U.S. patents to glean further background information: U.S. Pat. Nos. 4,108,739 to Tadokoro et al; 3,041,254 to Pepler; 3,041,255 to Passal et al; 2,069,566 to Tuttle; 3,303,111 to Peach; 3,475,293 to Haynes et al; 3,658,569 to Phillip et al; 3,759,803 to Du Rose et al; 4,086,149 to Martinsons et al; 4,113,248 to Yanagioka; 4,127,709 to Ruben; and 4,224,133 to Takahashi.

BRIEF DESCRIPTION OF THE ACCOMPANYING DRAWINGS

FIGS. 1*a*–1*e* schematically depict, in cross-section, a prior art technique for preparing fluid jet orifice plates; and FIGS. 2*a*–2*d* schematically depict, in cross-section, a method for preparing orifice plates (e.g. fluid jet orifice plates and/or photoetching masks or the like) in accordance with the present invention.

DETAILED DESCRIPTION OF THE PREFERRED EXEMPLARY EMBODIMENTS

The present invention is specifically concerned with utilizing the advantageous qualities of amorphous nickel- or cobalt-phosphorus alloys by depositing such alloys upon at least one surface of a highly corrosion-resistant substrate to form an orifice plate which is therefore resistive to corrosive fluids.

Amorphous nickel-phosphorus alloys in accordance with the present invention may be deposited by chemical reduction or electrolessly, as is described by A. Kenneth Graham, Electroplating Engineering Handbook, 3rd Ed., Van Nostrand Reinhold Co., New York, N.Y., pages 486–507 (1971), for example (the disclosure thereof being expressly incorporated hereinto by reference). Though generally these deposits contain 12 to 13 atomic percent phosphorus, formulations yielding up to 20 atomic percent phosphorus in the deposit exist where higher levels of phosphorus offer the most in corrosion protection. Such formulations are similar to, though more expensive to deposit, than amorphous nickel-phosphorus alloys that are electrodeposited and which are described in more detail below.

Certain amorphous materials have previously been electroplated. In particular, the plating of amorphous nickel- or cobalt-phosphorus alloys has been accomplished (see, A. Brenner, "Electrodeposition of Alloys", Volume II, Academic Press, New York, N.Y., Chapter 35 (1963), the disclosure thereof being expressly incorporated hereinto by reference). Such amorphous nickel- or cobalt-phosphorus alloys have now been found to exhibit significantly improved corrosion resistive properties when compared to conventional crystalline nickel or crystalline cobalt typically utilized in the production of fluid jet orifice plates, for example.

In particular, preferred nickel- or cobalt-phosphorus alloys can be prepared by the present invention which are highly stable and thus highly resistant to corrosion when the phosphorus content of the alloy is about 20 atomic percent with nickel or about 12 atomic percent with cobalt. Various electroplating baths suitable for depositing amorphous nickel- or cobalt-phosphorus alloys will be exemplified in greater detail below.

Figure 2A:
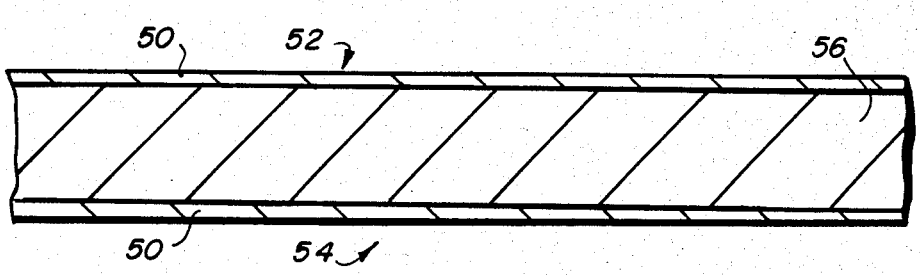
Figure 2B:
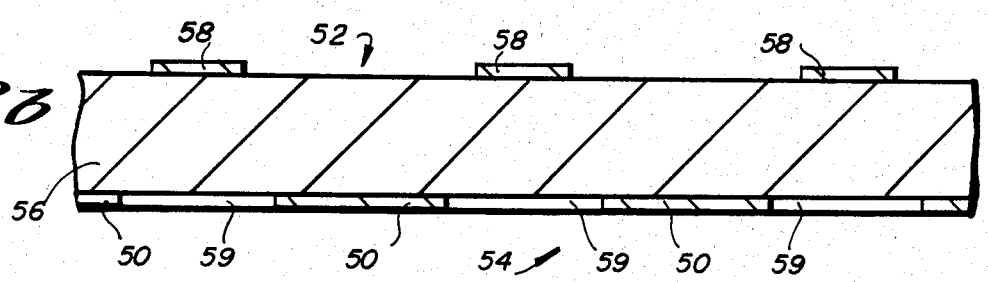
Figure 2C:
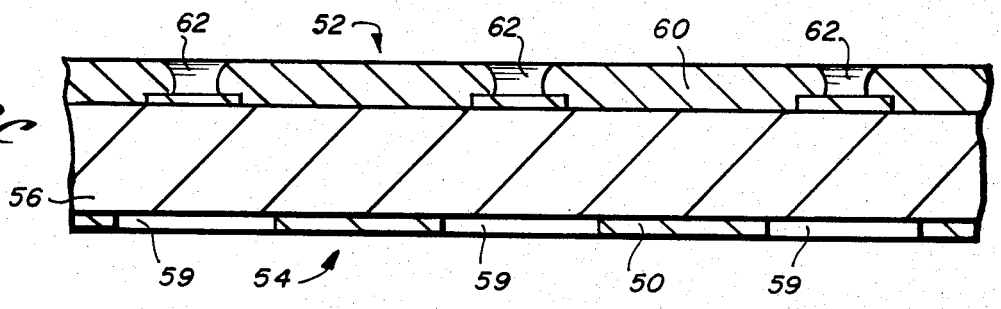
Figure 2D:
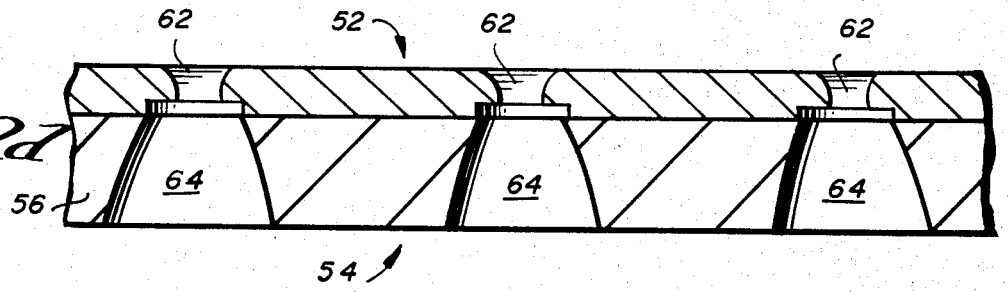

A preferred embodiment of the method according to the present invention is schematically depicted in FIGS. 2*a*–2*d*. As shown therein, a light sensitive photoresist material 50 is coated on both the front and back sides 52, 54, respectively, of substrate 56. Thereafter, the photoresist material 50 is modified by exposure to light utilizing suitable light masking techniques in such a manner that the unexposed photoresist pegs 58 remaining on the front side 52 after the exposed, oxidized photoresist material has been removed are in registry with openings 59 defined in photoresist material 50 on the back side 54 of substrate 56. The entire back side 54 of the substrate 56 is then covered with suitable plating protection means (not shown), e.g., plater's tape or the like, and the front side is thus plated with a nickel- or cobalt-phosphorus alloy 60 thereby pre-forming the orifices 62 thereon. After the orifices 62 have been pre-formed, the plating protection means is removed so as to expose the openings 59 in the photoresist material 50 on the back side 54 of substrate 50. Hot ferric chloride or other suitable etching compound may then be sprayed into the openings 59 so as to dissolve the metal substrate 56 immediately under them. No etching occurs in the areas covered by the photoresist material 50. Orifice formation is complete when the metal substrate has completely dissolved thereby forming a hole 64 through the thickness of substrate 56 in communication with each orifice 62.

Figure 1A:
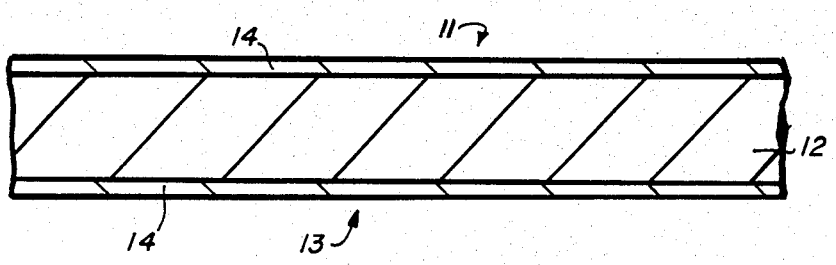
Fig. 1a PRIOR ART
Figure 1B:
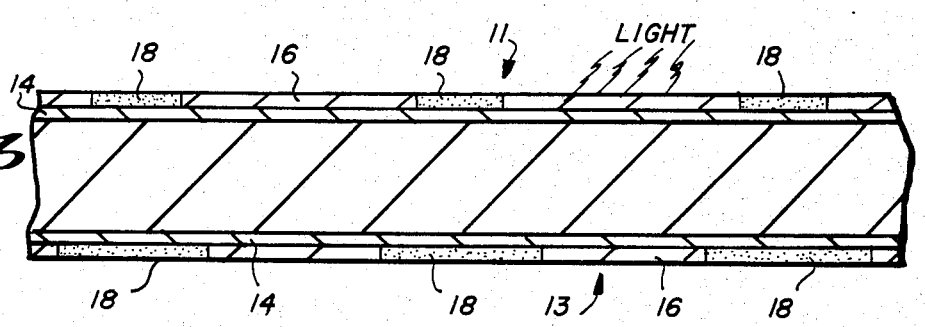
Figure 1C:
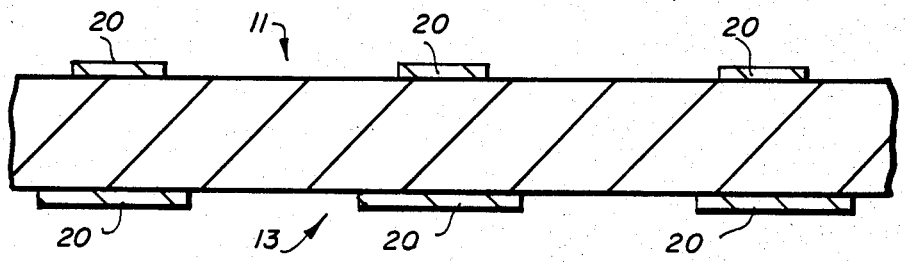
Figure 1D:
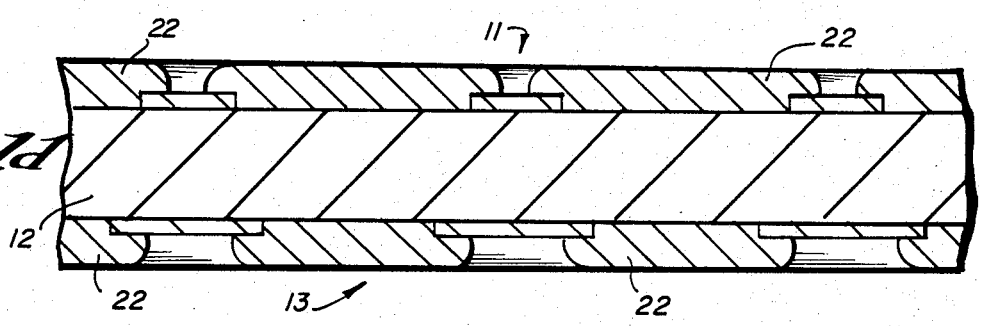
Figure 1E:
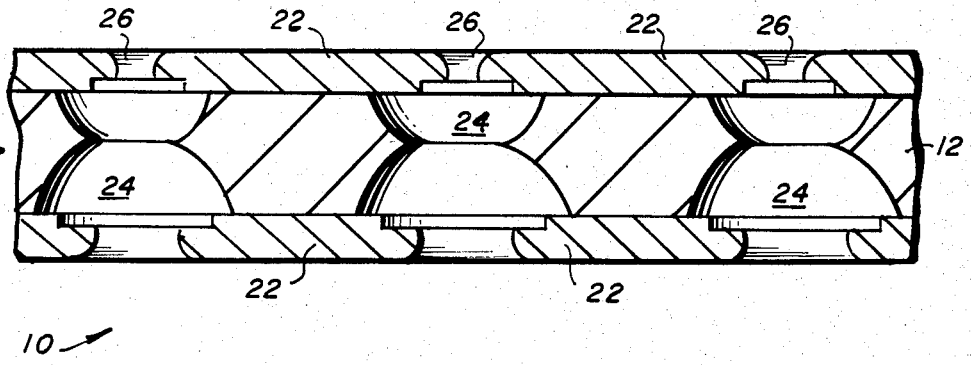

A second embodiment of the method according to the present invention is generally similar to the above-described method except the photoresist pegs are in alignment with one another (e.g., similar to the prior art method depicted in FIGS. 1*a*–1*e*). Thereafter, both the front and back sides of the substrate are simultaneously plated with an amorphous nickel- or cobalt-phosphorus alloy. In this embodiment, preferential etching will be accomplished between each of the openings in the amorphous alloy plating on the back side and the openings in the amorphous alloy plating on the front side, the amorphous alloy on both the front and back sides thus acting as etching masks.

EXAMPLES

The present invention is further described by way of the following nonlimiting Examples. In each of the following examples, certain electroplating baths were utilized to determine the effectiveness thereof in depositing amorphous nickel- or cobalt-phosphorus alloys on a substrate material.

In each of the following examples, the substrate was initially prepared by thorough surface cleaning utilizing an alkaline cleaning solution followed by an alkaline cleaning step wherein the substrate was soaked in the alkaline solution for about 4 minutes at 180° F. and thereafter rinsed with deionized water. Electrocleaning in 10% sulfuric acid (anodic) at a current of 50 amp/ft$^2$ for 4 minutes at 160° F. was then carried out followed by $H_2SO_4$ cathodic cleaning at 4 amps/Ft$^2$ for 4 minutes. After each cleaning treatment, the substrate was thoroughly rinsed with deionized water. The substrate was finally dipped in 10% HCl bath and rinsed with deionized water for about 1 minute. The substrate surfaces were completely clean and thus free of contaminate material.

Photoresist coatings of Kodak KTFR at 30 centipoise were applied to both sides of the substrate by withdrawing the material from a dip coater tank at a rate of 4 inches/minute with no agitation in which the photoresist material is maintained clean by continuously filtering it through a 0.2 micron screen. Thereafter the photoresist coatings were dried for about 30 minutes, prebaked in a convection oven at 100° C. for 20 minutes and trimmed to the proper size. Exposure of the photoresist was accomplished by placing the coated substrate in a master mask so as to expose only the desired areas. The coated substrate and master mask were placed in a vacuum bag at 25 inches Hg and exposed to light at 15 milliwatts/cm$^2$. Subsequent development included spraying the exposed areas with Kodak Micro Resist Developer for about 105 seconds. The developed areas were therafter removed from the substrate utilizing Kodak Micro Resist Rinse followed by air drying thereof for 5 minutes and post baking in a convection oven for 20 minutes at 140° C. The substrate was then activated by anodic electrocleaning for 30 seconds at 180° F. and thereafter rinsed with deionized water and dipped in room temperature 10% HCl solution and then subjected to a Woods nickel strike at 20 amps per ft$^2$ for about 4 minutes.

Electroplating was accomplished in baths of compositions noted below. After plating, a final rinse with deionized water was effected and the plated substrate was trimmed to its final size. The photoresist pegs are then removed by stripping in Fremont 561 (a photoresist stripping agent commercially available from Freemont Industries, Inc. of Shakopee, Minn.) in an ultrasonic cleaner.

Orifice formation was effected by etching the substrate utilizing 50% $FeCl_3$/50% deionized water at 130° F. under 18 psi spray pressure and a rate of about 0.0571 inches/sec. The etched plate was thereafter dried with dry $N_2$ and further dried in a convection oven at 140° C. for 15 minutes.

Final cleaning of the orifice plate was accomplished by stripping any residual photoresist utilizing Fremont 561 in an ultrasonic cleaner for 6–7 minutes followed by electrocleaning (cathodic) for 4 minutes at 2 amps.

Following the above general procedures the electroplating baths exemplified below were utilized.

EXAMPLE I

A substrate of polished, 5 mil thick 316 stainless steel was electroplated in a bath of the following composition:

| | |
|---|---|
| (a) Bath Composition: | .75 M $NiCl_2.6H_2O$ |
| | .25 M $NiCO_3$ |
| | 1.20 M $H_3PO_3$ |
| (b) Plating Conditions: | Temperature = 80° C. |
| | Current Density = 150 milliamp/cm$^2$ |

The plated 316 stainless steel substrate was etched with hot ferric chloride to form the required orifices and exhibited excellent corrosion resistive properties.

EXAMPLE II

Example I was repeated utilizing an electroplating bath of the following composition:

| | |
|---|---|
| (a) Bath Composition: | .80 M $NiSO_4.6H_2O$ |
| | .20 M $NiCl_2.6H_2O$ |
| | .50 M $H_3PO_3$ |
| | .50 M $H_3PO_4$ |
| (b) Plating Conditions: | Temperature = 80° C. |
| | Current Density = 150 milliamp/cm$^2$ |

The plated 316 stainless steel was etched with hot ferric chloride to form the required orifices and exhibited excellent corrosion resistive properties.

EXAMPLE III

Example I was repeated with the exception that titanium was utilized as a substrate in place of 316 stainless steel. Etching was accomplished utilizing a solution of potassium fluoride and hydrogen fluoride.

Similar corrosion resistive properties were observed.

EXAMPLE IV

Example II was repeated with the exception that zirconium was utilized as a substrate in place of 316 stainless steel. Etching was accomplished utilizing a solution of potassium fluoride and hydrogen fluoride.

Similar corrosion resistive properties were observed.

EXAMPLE V

A substrate of polished, 5 mil thick 316 stainless steel was electroplated in a bath of the following composition:

| | |
|---|---|
| (a) Bath Composition: | .76 M $CoCl_2.6H_2O$ |
| | .24 M $CoCO_3$ |
| | .50 M $H_3PO_4$ |
| | .50 M $H_3PO_4$ |
| (b) Plating Conditions: | Temperature = 75–95° C. |
| | Current Density = 200 milliamp/cm$^2$ |

Etching was again accomplished utilizing hot ferric chloride and the resulting orifice plate exhibited high corrosion resistance.

EXAMPLE VI

A substrate of polished, 5 mil thick 316 stainless steel was electroplated in a bath of the following composition:

| | |
|---|---|
| (a) Bath Composition: | 1.0 M $CoCl_2.6H_2O$ |
| | 1.0 M $H_3PO_3$ |
| | 1.0 M $NH_4OH$ |
| (b) Plating Conditions: | Temperature = 75–95° C. |
| | Current Density = 100 milliamp/cm$^2$ |

EXAMPLE VII

Examples V and VI were repeated with the exception that titanium was utilized as a substrate in place of stainless steel. Etching was accomplished utilizing a solution of potassium fluoride and hydrogen fluoride.

Similar corrosion resistive properties were observed.

The electroplated substrates of Examples I–VII have been found to be particularly stable against strong mineral acids at room temperature, such as, sulfuric acid, hydrochloric acid, hydrofluoric acid and phosphoric acid in addition to weak organic acids such as formic acid, acetic acid, propionic acid and oxalic acid. Furthermore, orifice plates in accordance with the present invention have been found to be stable against strong bases, such as, sodium and potassium hydroxides and resist weak organic bases such as the tertiary or aliphatic amines.

Thus, as can be seen from the foregoing, improved orifice plates (e.g. fluid jet orifice plates, photoetching masks and the like) can be constructed so as to be highly resistant to corrosive fluids, etc. typically encountered in textile applications, for example. However, as will be appreciated, the present invention is applicable to situations outside of textile applications and thus orifice plates produced thereby are advantageous wherever it is desired to utilize corrosive fluids in conjunction with fluid jet technology or wherever corrosion-resistant orifice plates are desirable such as in the photoetching industry.

Thus, while the present invention has been herein described in what is presently conceived to be the most preferred embodiments thereof, those in the art may recognize that many modifications may be made hereof, which modifications shall be accorded the broadest interpretation of the appended claims so as to encompass all equivalent methods, processes and/or products.

What I claim is:

1. A method of making an apertured member using a chemical etchant which method comprises:

depositing a layer of an amorphous phosphorus-containing metal alloy on at least one surface of a corrosion resistant substrate in a predetermined pattern defining a predetermined array of openings therein, and selectively chemically etching away at least a portion of said substrate by applying an etchant thereto which selectively etches away said substrate in the vicinity of said openings at a substantially greater rate than said alloy layer.

2. A method as in claim 1 wherein said alloy layer consists essentially of an amorphous nickel-phosphorus alloy and said substrate comprises a stainless steel.

3. A method as in claim 2 wherein the amount of phosphorus in said alloy is about 20 atomic percent.

4. A method as in claim 1 wherein said alloy layer consists essentially of an amorphous cobalt-phosphorus alloy.

5. A method as in claim 4 wherein the amount of phosphorus in said alloy is about 12 atomic percent.

6. A method as in claim 1 wherein said amorphous alloy layer is deposited on both sides of said substrate.

7. A method as in claim 1 wherein said member is a fluid jet orifice plate having a predetermined linear array of substantially circular openings.

8. A method as in claim 7 wherein the openings in said orifice plate are the same ones used in photoetching processes used in practice of said selectively chemically etching step and wherein hot ferric chloride is used as said etchant.

9. A method of making an apertured member having a predetermined array of openings therein, said method comprising the steps of:

(a) providing a highly corrosion resistant metallic substrate;

(b) depositing an amorphous phosphorus-containing metal alloy layer on at least one surface of said substrate, said alloy layer defining a predetermined array of openings each defining and exposing a corresponding area on said one surface; and (c) preferentially etching said substrate in the vicinity of said areas using an etchant containing hot ferric chloride which corrodes said substrate at a substantially higher rate than it corrodes said metal alloy layer to form an orifice array from which respective streams of fluid can issue.

10. A method as in claim 9 wherein the amorphous alloy is an amorphous nickel-phosphorus alloy and said substrate is a stainless steel.

11. A method as in claim 10 wherein step (b) is practiced by immersing the substrate in an electrodeposition bath consisting essentially of 0.75M $NiCl_2.6H_2O$; 0.25M $NiCO_3$; and 1.25M $H_3PO_3$, and supplying electrical current to said substrate to effect electrodeposition of said amorphous nickel-phosphorus alloy.

12. A method as in claim 9 wherein the amorphous alloy is an amorphous cobalt-phosphorus alloy.

13. A method as in claim 12 wherein step (b) is practiced by immersing the substrate in an electrodeposition bath consisting essentially of 1M $CoCl_2.6H_2O$; 1M $H_3PO_3$; and 1M $NH_4OH$, and supplying current to said substrate to effect electrodeposition of said amorphous nickel-phosphorus alloy.

14. A method as in claim 9 wherein said apertured member is a fluid jet orifice plate and wherein step (b) is practiced by providing a linear array of substantially circular openings in said alloy layers, each opening defining a corresponding substantially circular exposed area on said one surface of the substrate prior to step (c).

15. A method as in claim 14 wherein after step (a) and before step (b) there is practiced the step of (i) masking a plurality of circular areas on at least one surface of said substrate to prevent deposition of said alloy thereon.

16. A method as in claim 15 wherein after step (i) and before step (b) there is practiced the step of (ii) masking a portion of the other side of said substrate to define a plurality of circular areas thereon each registrable with a corresponding circular area on said one surface of said substrate.

17. A method as in claim 16 wherein step (b) is further practiced by covering the other side of said substrate with means for preventing deposition of the alloy thereon.

18. A method as in claim 17 wherein step (c) is practiced according to the steps of:

(1) removing the means for preventing deposition of the alloy;

(2) contacting each of the circular openings defined on the other side of said substrate with hot ferric chloride to effect etching thereof; and (3) practicing step (2) until an orifice is formed through the substrate corresponding to each of the registered pairs of circular openings defined on said sides of the substrate.

19. An apertured member comprising a substrate of highly corrosion resistant metal and a layer of an amorphous phosphorus-containing metal alloy formed on at least one surface of said substrate, said substrate and said layer together having a predetermined array of aligned openings therethrough.

20. A member as in claim 19 wherein said amorphous metal alloy is an amorphous nickel-phosphorus alloy.

21. A member as in claim 20 wherein the amount of phosphorus in said alloy is about 20 atomic percent.

22. A member as in claim 19 wherein said amorphous metal alloy is an amorphous cobalt-phosphorus alloy.

23. A member as in claim 22 wherein the amount of phosphorus in said alloy is about 12 atomic percent.

24. A member as in claim 20 wherein said substrate is stainless steel.

25. A member as in claim 20 wherein said substrate is titanium.

26. A member as in claim 19 wherein said substrate and layer together define a predetermined linear array of generally circular apertures each for issuing a stream of fluid therethrough.

27. In combination with a fluid jet printing apparatus, a member as in claim 26.

28. A member as in claim 21 wherein said substrate is stainless steel.

29. A member as in claim 21 wherein said substrate is titanium.

30. In combination with a fluid jet printing apparatus, a member as in claim 20.

31. In combination with a fluid jet printing apparatus, a member as in claim 22.

32. An orifice plate comprising:

a substrate of stainless steel having opposing top and bottom surfaces; and a layer of electro-deposited amorphous nickel-phosphorus alloy formed on at least one of said surfaces and having an array of orifice-defining apertures formed therein, said substrate including chemically etched apertures formed therethrough in alignment with said orifice-defining apertures.

33. An orifice plate as in claim 32 further comprising:

a second layer of electro-deposited amorphous nickel-phosphorus alloy formed on the other of said surfaces and having an array of apertures formed therein in alignment with said orifice-defining apertures and with said chemically etched apertures of the substrate.

34. An orifice plate comprising:

a substrate of stainless steel having opposing top and bottom surfaces; and a layer of electro-deposited amorphous cobalt-phosphorus alloy formed on at least one of said surfaces and having an array of orifice-defining apertures formed therein, said substrate including chemically etched apertures formed therethrough in alignment with said orifice-defining apertures.

35. An orifice plate as in claim 34 further comprising:

a second layer of electro-deposited amorphous cobalt-phosphorus alloy formed on the other of said surfaces and having an array of apertures formed therein in alignment with said orifice-defining apertures and with said chemically etched apertures of the substrate.

36. A method for selectively chemically etching a stainless steel substrate member, said method comprising the steps of:

selectively electrodepositing on said substrate member an amorphous phosphorus alloy layer but only over areas which are not to be subsequently etched; and preferentially etching the portions of said substrate member not covered by said amorphous nickel-phosphorus alloy layer with a hot ferric chloride etchant that attacks the stainless steel substrate member with greater activity than it attacks the alloy layer.

37. A method as in claim 36 wherein said phosphorus alloy comprises nickel-phosphorus.

38. A method as in claim 36 wherein said phosphorus alloy comprises cobalt-phosphorus.

39. A mask for use in selectively chemically etching a stainless steel substrate, said mask comprising:

a patterned electro-deposited layer of amorphous phosphorus alloy having a predetermined pattern of apertures formed therein through which a chemical etchant may pass.

40. A mask as in claim 39 wherein said phosphorus alloy comprises nickel-phosphorus.

41. A mask as in claim 39 wherein said phosphorus alloy comprises cobalt-phosphorus.

* * * * *